United States Patent [19]

Bung et al.

[11] Patent Number: 4,485,055

[45] Date of Patent: Nov. 27, 1984

[54] REPRODUCIBLE PRODUCTION OF SHAPED ARTICLES OF VARIOUS GEOMETRIES FROM POLYMER DISPERSIONS, MELTS OR SOLUTIONS

[75] Inventors: Richard Bung; Karl Gans; Gerold Schreyer, all of Ludwigshafen; Gerhard Welzel, Mannheim, all of Fed. Rep. of Germany

[73] Assignee: BASF Aktiengesellschaft, Fed. Rep. of Germany

[21] Appl. No.: 400,047

[22] Filed: Jul. 20, 1982

[30] Foreign Application Priority Data

Jul. 22, 1981 [DE] Fed. Rep. of Germany ..... 3128872

[51] Int. Cl.[3] ..... B01J 2/02

[52] U.S. Cl. ..... 264/8

[58] Field of Search ..... 264/8

[56] References Cited

U.S. PATENT DOCUMENTS

| | | | |
|---|---|---|---|
| 2,439,772 | 4/1948 | Gow | 264/8 |
| 4,127,158 | 11/1978 | Matsuno | 264/8 |
| 4,197,063 | 4/1980 | Davidson | 264/8 |
| 4,303,433 | 12/1981 | Torobin | 264/8 |
| 4,323,524 | 4/1982 | Snowden | 264/8 |

*Primary Examiner*—James R. Hall

*Attorney, Agent, or Firm*—Keil & Weinkauf

[57] ABSTRACT

A process for the repeatable production of shaped particles of various geometries from polymer dispersions, melts or solutions, wherein first particles are expelled by means of a rotating disk and are introduced while still liquid, in a radially outward direction, into a liquid precipitant or fixant film and the particles are thereby coagulated or fixed and also given an additional structure and are transported away from the point of introduction.

8 Claims, 1 Drawing Figure

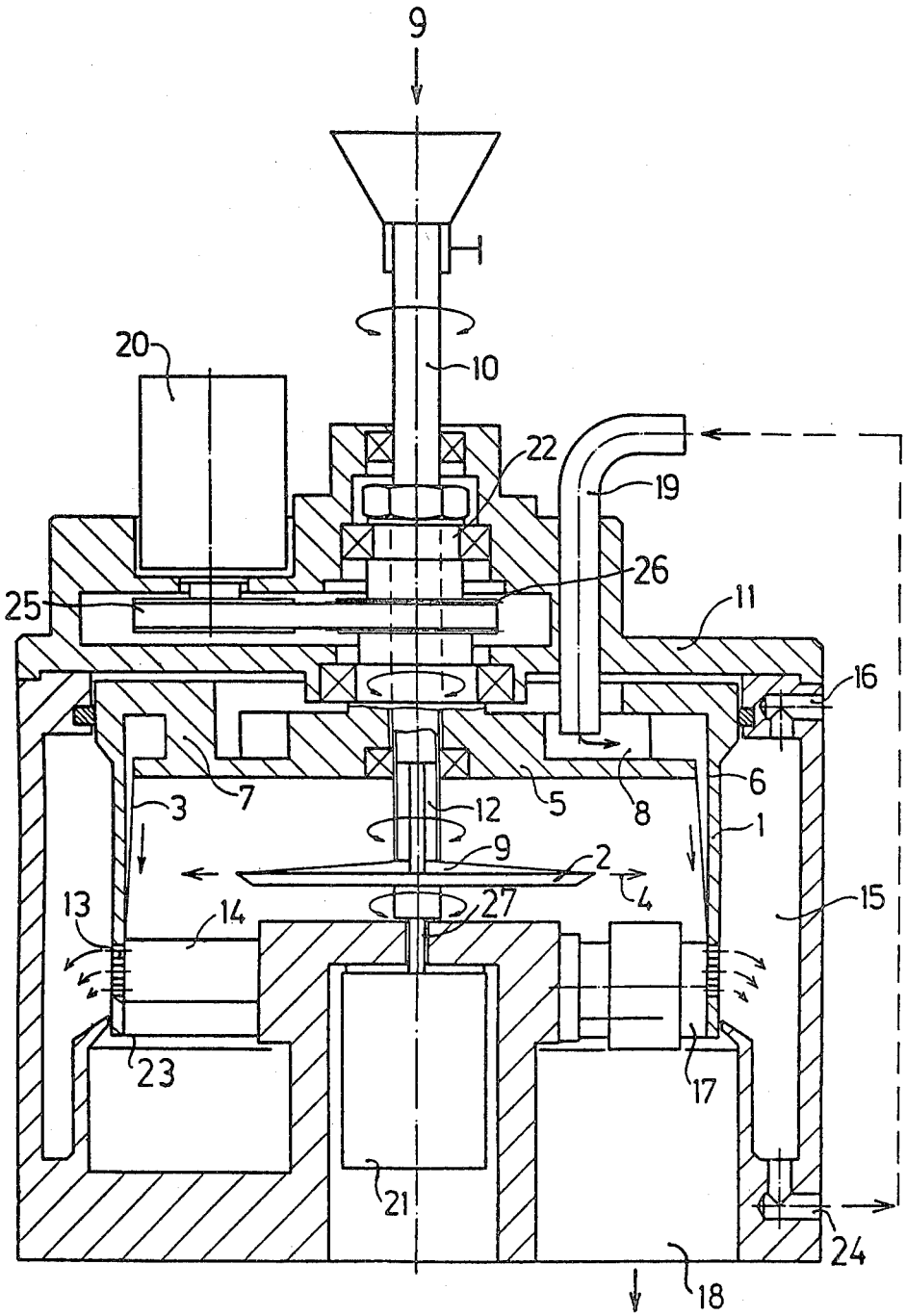
9
10
20
22
19
26
25
11
16
7
3
12
5
8
6
1
9
2
4
13
14
27
15
23
17
21
24
18

REPRODUCIBLE PRODUCTION OF SHAPED ARTICLES OF VARIOUS GEOMETRIES FROM POLYMER DISPERSIONS, MELTS OR SOLUTIONS

The present invention relates to a process for the repeatable production of shaped particles of various geometries from polymer dispersions, solutions or melts.

Hitherto shaped particles, such as bonding fibers or fibrids for bonding nonwovens, have always been prepared from a polymer dispersion or solution by precipitation with a precipitation fluid under high shearing stresses. For example, U.S. Pat. No. 2,999,788 proposes effecting the precipitation in a kettle with vigorous stirring, or by injection at a high relative velocity of the precipitation fluid. German Laid-Open application DOS No. 1,660,628 describes effecting the precipitation after the dispersion has issued from a capillary into a turbulent precipitation bath which flows directly past the capillary. Swiss Pat. No. 487,672 describes a precipitation apparatus in which vigorous shearing is generated by means of rotors and shearing blades. In the process of German Laid-Open application DOS No. 2,159,871, the polymer dispersion is injected as a thin jet, under pressure, into a moderately stirred precipitation bath; the process requires the polymer to have a particular glass transition temperature. According to German Laid-Open application DOS No. 2,326,143, fibrids are obtained by precipitation in a shearing zone, produced by nozzles, in the precipitation bath. Finally, German Laid-Open application DOS No. 2,516,561 also describes precipitation in a shearing zone, the mean energy density being not less than 5 W.sec/cm$^3$. In all these processes, the shaped particles described as bonding fibers are produced by precipitation with simultaneous breaking-up in a shearing zone of a precipitation bath. It is true that in this way network-like fibrids of complicated shape can be produced, but bonding particles having a simple, reproducible geometry which can be varied at will cannot be obtained.

Processes for the production of mineral fibers and metal powders have also been disclosed. For example, they are described in Ullmanns Encyklopädie der technischen Chemie, volume 7 (1956) and volume 12 (1960), and in U.S. Pat. No. 2,451,546. These processes can be used to convert glass, metal or mineral melts into threads or beads which solidify in air or in a waterbath, to give threads or powders. An additional, deliberate shaping of the particles produced, while they are still liquid, so as to give, for example, ribbon-shaped fibers or lamellae, and to fix this shape securely, is not possible without additional process steps.

Processes for the production of granules from plastic melts have also been disclosed. Essentially, these comprise producing extruded threads, which are then mechanically broken up into cylindrical particles. Spherical granules are produced by atomization of plastic melts. These processes, again, do not permit any additional deliberate shaping of the particles which may be required to optimize their suitability for further processing.

Atomization of liquids by means of rotating disks is also prior art and is described in detail in P. Theissing, Erzeugung von Flüssigkeitsfilmen, Flüssigkeitslamellen und Tropfen durch rotierende Scheiben; VDI-Forschungsheft 574, VID-Verlag GmbH, Düsseldorf 1976.

This process by itself is however incapable of producing, for example, bonding particles from polymer dispersions, since the threads, droplets or lamellae produced must, instead of being dried as is conventional, be varied in respect of shape and be coagulated or fixed in a precipitant or fixant.

It is an object of the present invention to provide a process which permits the deliberate and repeatable production of shaped particles of various selected geometries from a liquid form product such as polymer dispersions, melts or solutions, wherein the particles are coagulated, or fixed in shape, in a precipitant or fixant respectively in the form of a liquid carrier, and are obtained as a suspension of variable solids content in the particular liquid carrier. It is a further object to obtain shaped particles whose geometry can be varied from fibrous and lamellar through to spherical and flaky structures. It is yet a further object to obtain particles which have a narrow range of shapes, thereby giving best possible processing characteristics and use parameters.

Generally speaking the process of the present invention is to centrifugally expel and break up first particles of liquid form product, such as polymer dispersions, melts, or solutions, into a thin body of liquid precipitant or fixant material, such as a liquid film, wherein such first particles become at least partially solidified and may be further shaped; and then separating the shaped particles from the precipitant or fixant liquid. The first particles may be in the form of droplets, threads, lamellae, and the like; and the finally shaped particles may be produced as fibers, spheres or flakes, or the like, largely through control of centrifugal expelling and relative movement of the body of liquid precipitant or fixant.

Apparatus for performing the process is shown in the drawing and comprises an expeller means for the liquid form product, preferably a centrifugal expeller such as a rotatable disk 2, and a movable vessel for maintaining a thin body of liquid precipitant or fixant in proximity to said expeller means. Preferably the movable vessel comprises a hollow cylinder 1 rotatable about its axis and enveloping the expeller means with an inner surface across which a liquid film may be caused to flow in an axial direction from an inlet end to an outlet end. Also preferably the movable vessel is contained within a housing 11 wherein the liquid precipitant or fixant may be recovered.

The liquid form product such as a polymer dispersion, solution or melt is first broken up, for example by applying it to a rotating disk 2 which centrifugally expels the product in the form of particles such as threads, droplets or lamellae, and such particles, while still liquid, are then introduced into a body of precipitant or fixant in the form of a liquid film which is caused to co-rotate or counter-rotate relative to the disk 2. Depending on the direction and magnitude of the adjustable relative speed of the particles first produced and the precipitant or fixant liquid film, the particles undergo an additional deliberate shaping and are coagulated, or fixed in shape. In this way it is possible, for example, to reduce the size of relatively long threads, flatten droplets into the shape of small disks and cause additional branching of lamellae which are still liquid. As a result of the axial flow of the film, the shaped particles are transported away from the point of introduction, without undergoing agglomeration, and are discharged as a suspension in the precipitant or fixant. The particular advantage of this process is that particles which have previously undergone preliminary shaping and are still liquid, can be subjected to additional and deliberate shaping, caused by the precipitant or fixant and the rotating vessel in which it is contained.

In order to produce the rotating liquid film of precipitant or fixant in a stable and simple manner, an embodiment of the invention provides that the precipitant or fixant is applied through a rotating annular gap onto the inner surface of a vessel which also rotates coaxially with the disk 2 and is open on one or more axial ends. The lengthwise geometry of the vessel may be cylindrical, funnel-shaped or curved. As a result of the internal lengthwise geometry, and by providing annular recesses or protrusions on the inner wall of the rotating vessel, the centrifugal forces generated in the precipitant or fixant will create storage volumes against the inner surface, which make it possible to adjust the residence time within the vessel by varying the feed rate of precipitant or fixant, and accordingly make it possible to vary the resulting coagulation time or fixing time of the shaped particles before the suspension is discharged.

A further embodiment of the invention provides that fillers are admixed in the precipitant or fixant before liquid film formation, so that when the shaped particles are introduced a homogeneous suspension of the filler and the shaped particles results.

In addition, annularly arranged perforations are provided upstream of the discharge orifice of the vessel, and these, by virtue of their geometry and of the rotation of the vessel, assisted or reduced by pressure or suction imposed on the outer space relative to the inner space of the said vessel, permit adjustable centrifuging-off of the excess precipitant or fixant.

The drawing shows a sectional elevation view of a precipitating or fixing apparatus, for carrying out the process according to the invention, and illustrates the flow of product and of precipitant or fixant. Essentially, the precipitating apparatus comprises a rotating hollow cylinder 1 with a distributor plate 5 at one end with an annular fixant feed channel 8 to receive liquid precipitant/fixant from a supply tube 19, and a rotating disk 2 with liquid form product feed line 10 located within the hollow cylinder 1. The liquid form product 9 is applied centrally onto the disk 2 via the feed tube 10 and the rotation of the disk breaks the product up, at the disk edge, into first particles, designated by the arrow 4, which may be in the form of droplets, threads or lamellae. The particles 4, while still liquid, are introduced in a radially outward direction from the disk 2, by virtue of the centrifugal force, into a liquid film 3 emanating from the feed channel 8 through a gap 6. The liquid film 3 rotates with the inner surface of the hollow cylinder 1, and is transported downwards toward an open outlet end 23 to carry the particles 4 away from the point of introduction. Below the annular introduction zone and toward the open end, the hollow cylinder 1 has another annular zone with holes 13, which are covered on the inside with a pervious foil 14 to permit escape of liquid but not the final particles. The centrifugal forces acting on the precipitant/fixant suspension centrifuge off the liquid into an annular chamber 15. The moist product particles which remain are discharged, by means of scrapers 17, supported from a housing 11 in a star-shaped pattern about the interior of the outlet end 23 of hollow cylinder 1, and into cavities 18, below the scrapers 17, of a stationary housing 11. The housing 11, which may be constructed of connected parts, extends from beneath the hollow cylinder 1 upwardly about the outside and thence above the cylinder and is spaced at the sides to form an annular chamber 15 between the housing 11 and cylinder 1. Through vents 16 in the housing 11 the annular chamber 15 can be subjected to pressure or suction relative to the interior space of the hollow cylinder 1, and in this way the amount of fixant centrifuged off can be varied independently of the speed of rotation of the hollow cylinder 1. Discharge ports 24 in the housing 11 at the bottom of the annular chamber 15 allow the fixant centrifuged off to be discharged and, for example, to be recycled by being returned to the supply tube 19.

As mentioned, the liquid supplied via the tube 19 is introduced into the annular channel 8 of the distributor plate 5. As a result of the rotation of the distributor plate 5 and of the annular channel 8, the liquid is centrifuged outwards and conveyed through the annular gap 6 between the distributor plate 5 and the inner wall of the hollow cylinder 1. Connecting fins 7, distributed over the periphery of the annular channel 8, assist the rotational acceleration of the statically supplied liquid fixant. This creates a fixant stock, distributed uniformly over the periphery of the annular channel 8 and rotating with the latter, and as a result of this stock of fixant the annular gap 6 can produce a liquid fixant film which also co-rotates and is of uniform thickness.

The liquid form product in question is, in the embodiment shown, fed centrally through a hollow axle 22 of the distributor plate 5 onto the disk 2. The feed tube 10 is rotatably mounted in the hollow axle 22 and is connected to the disk 2 by blade-like webs 12 and their axis. In this way, the feed tube 10 can co-rotate with the disk 2 independently of the speed of rotation of the axle 22 and distributor plate 5. The hollow cylinder 1 and the disk 2 are, in the embodiment shown, driven separately by motors 20 and 21, respectively; the motor 20 being connected by a drive belt 25 to a sheave 26 on the axle 22, and motor 21 may be connected directly by a drive shaft 27 to the disk 2. In this way, the speeds of rotation of the liquid fixant film 3 and distributor disk 2 can be varied independently of one another, so that reproducible secondary shaping of the first particles which are still liquid when initially immersed in the film 3 can be achieved.

The advantages achievable by means of the invention are in particular that, in place of substantially turbulent and random breaking up, shaping and fixing of particles of a product, such particles may be produced first with a narrow range of shapes and, while still liquid, can be converted by controllably adjustable and variable secondary deformation, accompanied by fixing, into final shaped particles of various geometries and shapes. This permits optimum adaption of the geometry of the shaped particles to the particular end use. For example, the depth of penetration of bonding particles, made from polymer dispersions, in nonwovens, and accordingly the mechanical properties of the latter, can be optimized or varied.

A further advantage is that filler particles can be admixed to the product or the fixant before the shaped particles are produced, as the result of which the particles can, simultaneously with fixing, be homogeneously mixed with the filler particles, without requiring an additional process step.

A further advantage is that the apparatus for carrying out the process is compact, so that the novel process can, cheaply and without problems, be carried out upstream of further processing, for example upstream of an apparatus for the wet-lay production of nonwovens.

We claim:

1. A process for the repeatable production of shaped particles of various geometries from a liquid form product such as a polymer dispersion, melt or solution, said process comprising: centrifugally expelling said liquid form product from a rotating member in the form of particles, and introducing said particles while still liquid, in a radially outward direction, into a rotating liquid film of precipitant or fixant whereby said particles are coagulated or fixed and also given an additional structure and are transported away from the point of introduction.

2. A process as claimed in claim 1, wherein the rotation of the liquid film of precipitant or fixant is effected by introducing the precipitant or fixant onto the inner wall of a rotating hollow cylinder which is open on one or more ends.

3. A process as claimed in claim 2, wherein the inner surfaces of the rotating hollow cylinder have annular recesses or protusions, by means of which, by virtue of the action of centrifugal force, locally accelerated or retarded speeds of the liquid film can be obtained.

4. A process as claimed in claim 1, wherein filler particles are admixed to the liquid film, so that, conjointly with the shaped particles produced from said liquid-form product a homogeneous suspension of shaped particles and filler particles is produced.

5. A process as claimed in either of claim 2 or 3, wherein the rotating liquid film is produced by introducing a precipitant or fixant liquid across a distributor plate which forms an annular gap with the inner surface at one end of said hollow cylinder, the precipitant or fixant being supplied via an annular channel provided with impellar ribs on said plate.

6. A process as claimed in claim 2, wherein the rotating hollow cylinder possesses, upstream of its open end annularly arranged perforations which are covered by a screen foil and permit centrifuging-off of the liquid film into an annular chamber which, to increase or reduce the amount of liquid discharged can be subjected to pressure or suction relative to the interior of the hollow cylinder.

7. A process as claimed in claim 6, wherein one or more inclined scrapers are arranged in a star-shaped pattern to wipe the interior of the hollow cylinder in the zone of the screen foil, the ends of the scrapers extending to or beyond the open end of the hollow cylinder, thereby allowing moist product to be discharged in a gentle manner, and solely at the position of the scraper, into the discharge cavity of a housing.

8. A process as claimed in claim 2, wherein the liquid form product is expelled across a rotating disk and wherein said disk and said hollow cylinder are driven to rotate independently of one another.

* * * * *